US006815039B2

(12) United States Patent
Riley

(10) Patent No.: US 6,815,039 B2
(45) Date of Patent: Nov. 9, 2004

(54) RESISTANCE ELEMENT FOR POTENTIOMETRIC DEVICES, AND METHOD OF MANUFACTURE

(75) Inventor: Richard E. Riley, Riverside, CA (US)

(73) Assignee: BEI Technologies, Inc., San Francisco, CA (US)

( * ) Notice: Subject to any disclaimer, the term of this patent is extended or adjusted under 35 U.S.C. 154(b) by 0 days.

(21) Appl. No.: 10/081,123

(22) Filed: Feb. 21, 2002

(65) Prior Publication Data

US 2003/0190457 A1 Oct. 9, 2003

(51) Int. Cl.[7] ..... H01C 10/32

(52) U.S. Cl. ..... 428/141; 428/143; 428/147; 428/148; 338/118; 338/160; 338/162; 338/171

(58) Field of Search ..... 428/141, 143, 428/147, 148; 338/118, 160, 162, 171; 174/256, 257; 252/511

(56) References Cited

U.S. PATENT DOCUMENTS 4,224,595 A * 9/1980 Dolan ..... 338/34
4,278,725 A 7/1981 Riley et al. ..... 428/208
4,404,237 A * 9/1983 Eichelberger et al. ..... 427/96
4,640,981 A * 2/1987 Dery et al. ..... 174/88 R
4,732,802 A * 3/1988 Bosze et al. ..... 428/210
4,824,694 A 4/1989 Bosze et al. ..... 427/102
5,855,820 A * 1/1999 Chan et al. ..... 252/511
5,949,029 A * 9/1999 Crotzer et al. ..... 174/254
5,977,489 A * 11/1999 Crotzer et al. ..... 174/257
6,228,288 B1 * 5/2001 Chacko ..... 252/511

* cited by examiner

*Primary Examiner*—Harold Pyon
*Assistant Examiner*—Alicia Chevalier
(74) *Attorney, Agent, or Firm*—Dorsey & Whitney LLP

(57) ABSTRACT

Conductive plastic resistance element having particles of conductive material embedded therein and projecting therefrom for reducing variations in contact resistance in a potentiometric device in which the element is employed. The element is made by processing carbon powder, resin, solvent and conductive phases to form a paste, applying the paste to a substrate, and curing the paste to drive off the solvent and form a film, with the conductive phases rising to the surface of the film and becoming embedded therein.

25 Claims, No Drawings

RESISTANCE ELEMENT FOR POTENTIOMETRIC DEVICES, AND METHOD OF MANUFACTURE

BACKGROUND OF THE INVENTION

1. Field of Invention

This invention pertains generally to variable resistors and, more particularly, to a conductive plastic resistance element for use in potentiometric devices, and to a method of manufacturing the same.

2. Related Art

In potentiometers and other types of variable resistors, the rubbing action between the so-called wiper contacts and the resistive elements can change the topography or surface contour of the resistive elements over the lifetime of the devices. Such changes produce variations in resistance between the contacts and the resistive elements, and those variations can result in disturbances and erroneous readings in sensors and other instruments in which the potentiometers are utilized.

With conductive plastic resistance elements, there is relatively little wear on the elements, but there is a slight smoothing or polishing in the areas which are contacted by the wipers. This removes surface protrusions and decreases effective contact pressure, resulting in increased electrical resistance or noise between the resistance element and the wiper contact. In addition, a thin film of insulating material may form on the surface of the element due to the presence of lubricants and plastic material in the element.

Heretofore, the most widely used technique for reducing contact resistance variations with conductive plastic resistance elements has been to increase the contact pressure and to use a silicone lubricant between the wiper and the resistance element.

With other types of resistive elements, variations in contact resistance have been reduced by embedding particles of conductive material in the surface of the resistive element which is engaged by the wiper contact. U.S. Pat. Nos. 4,278,725 and 4,824,694, for example, show the use of conductive particles in cermet resistive elements, i.e. elements containing a mixture of ceramic and metallic materials. Such techniques have not, however, heretofore been employed in conductive plastic resistance elements.

OBJECTS AND SUMMARY

It is in general an object of the invention to provide a new and improved resistance element for use in potentiometric devices, and to a method of manufacturing the same.

Another object of the invention is to provide a resistance element and method of the above character which overcome the limitations and disadvantages of conductive plastic resistance elements of the prior art.

These and other objects are achieved in accordance with the invention by providing a conductive plastic resistance element having particles of conductive material embedded therein and projecting therefrom for contact by the wiper of a potentiometric device in which the resistance element is employed. The resistance element is made by processing carbon powder, resin, solvent and conductive phases to form a paste, applying the paste to a substrate, and curing the paste to drive off the solvent and form a film, with the conductive phases rising to the surface of the film and becoming embedded therein.

DETAILED DESCRIPTION

A conductive plastic resistance element is made by combining carbon powder with a resin and solvent mixture, along with other fillers, wetting agents, and other components. These materials are mixed in a high shear mixer to form a viscous paste which is then screen printed onto a substrate and cured at temperatures on the order of 200° C. The curing operation drives off the solvents and crosslinks the plastic matrix to form a hard, abrasion resistant film. Carbon is the current carrying phase, and a higher percentage of carbon produces a cured film of lower resistance.

It has been found that electrical noise or variations in contact resistance can be significantly reduced by including conductive phases in the carbon/plastic matrix. One presently preferred conductor for this purpose is silver, particularly a deagglomerated spherical silver powder having a particle size of about 6.0 $\mu$m or less.

This silver is preferred because it has smooth, generally round particles that will not absorb excessive amounts of solvent in the mixture for the conductive plastic resistor material. In addition, the round shape promotes good electrical contact without excessively lowering the resistance value of the material. This is in contrast to flaked materials which tend to join together in a matrix of such materials and lower the resistance value significantly. The silver has a further advantage in that it is less costly than other materials such as palladium, gold or platinum.

It is believed that other metals such as palladium, gold, platinum and copper can be used in place of or in addition to silver. It is also believed that other metals and other conductive materials such as highly conductive forms of carbon can also be used. As noted above, however, silver is the preferred material because the silver particles enhance the conductivity between the wiper and the resistive element without degrading the wear properties of the element or producing major changes in its resistance value.

Another example of a material which has been used with good results is a mixture of silver and palladium in the form of a high purity, spherical, deagglomerated coprecipated powder containing about 70 percent silver and 30 percent palladium. Such a powder is available from Degussa Corporation, South Plainfield, N.J., under the product code K7030-10. This powder has properties similar to silver in reducing contact resistance variation, but it does have an effect on the resistance and a minor effect on the wear properties of the resistive element.

The amount and shape of the conductive phases is dependent to some extent on the contact resistance desired and on the type of contact used in the potentiometric device, and it is generally preferable that the amount of conductive material not be so great as to produce undesired changes in the electrical and mechanical properties of the resistance element. It has been found that the addition of about 10 to 20 percent silver or other metal (by weight) will significantly reduce the variation in contact resistance or surface conductivity without degrading the wear properties and overall resistance of the conductive plastic material. However, it is believed that useful range of added conductive phases extends from about 2 percent to about 50 percent (by weight).

In one presently preferred embodiment, the resistance element is manufactured by processing carbon powder, resin, solvent and conductive phases in a high shear mixer to form a paste, screen printing the paste onto a substrate, curing the paste at a temperature on the order of 200° C. to drive off the solvent and form a film, with the conductive phases rising to the surface of the film and becoming embedded therein.

EXAMPLE 20 grams of a deagglomerated spherical silver powder having a particle size of about 6.0 $\mu$m or less were mixed with 80 grams of resistor ink comprising a suspension of carbon, boron nitride, and polytetrafluoroethylene powders in a solution of phenol resin in a mixture of butyl carbitol acetate and butyl carbitol.

The mixture was processed on a 3 roll mill using 150 pounds of roller pressure and two passes to thoroughly distribute the silver particles in the mixture. This ink was then printed onto a substrate and cured at a temperature of 200° C. for two hours.

The resistive element was tested and compared with another element made from the same ink without the silver particles. After 750,000 strokes with a wiper, the element with the silver particles had a contact resistance variation of only 1000 ohms, as compared with 6000 ohms for the element without the silver. Similar results were obtained after a 1.5 million strokes.

It is apparent from the foregoing that a new and improved conductive plastic resistance element and method of manufacture have been provided. While only certain presently preferred embodiments have been described in detail, as will be apparent to those familiar with the art, certain changes and modifications can be made without departing from the scope of the invention as defined by the following claims.

What is claimed is:

1. A conductive plastic resistance element in a variable resistor having a wiper for movably contacting said resistance element to vary the resistance of the variable resistor, the resistance element comprising:

a substrate;

a carbon and plastic resistive matrix disposed as a layer on said substrate and having a layer thickness, said carbon being a current carrying phase of the matrix wherein a higher percentage of carbon relative to the percentage of plastic in the carbon and plastic resistive matrix produces a lower resistance and a lower percentage of carbon relative to the percentage of plastic in the carbon and plastic resistive matrix produces a higher resistance; and particles of conductive material no larger than about 6 microns formed in situ and embedded in a surface of said layer of resistive matrix and exposed and projecting therefrom in sliding contact with the wiper contact of the variable resistor, said particles of conductive material forming a conductive phase at the surface operative to reduce a contact resistance between said resistive element and said wiper and being present in sufficient amount within a volume of said layer without excessively altering the resistive properties of said resistive matrix, said particles of conductive material projecting therefrom in sliding contact with the wiper contact of the variable resistor without degrading the wear properties of the resistive element.

2. The resistance element of claim 1 wherein the conductive material is deagglomerated smooth substantially round metallic silver powder that promotes good electrical contact with said wiper and does not tend to join together and thereby does not tend to lower the resistance of the carbon-plastic resistive matrix.

3. The resistance element of claim 1 wherein the conductive material is silver and palladium deagglomerated spherical metallic powder containing about 70 percent silver and 30 percent palladium that promotes good electrical contact with said wiper and does not tend to join together to form conductive metallic paths at said surface or through portions of the carbon-plastic resistive matrix and thereby does not excessively lower the resistance of the carbon-plastic resistive matrix.

4. The resistance element of claim 1 wherein the conductive material is selected from the group consisting of silver, palladium, gold, platinum, copper, highly conductive carbon, and combinations thereof; and said conductive material is in the form of a deagglomerated spherical metallic powder that promotes good electrical contact with said wiper and does not tend to join together and thereby does not excessively lower the resistance of the carbon-plastic resistive matrix.

5. The resistance element of claim 1 wherein the conductive material is present in an amount equal to about 10 to 20 percent by weight of the resistive element.

6. The resistance element of claim 1 wherein the conductive material is present in an amount equal to about 2 to 50 percent by weight of the resistive element.

7. A resistance element in a potentiometric device having a wiper contact which movably engages the resistance element to vary the resistance of the potentiometer device, comprising:

a substrate;

a carbon and/plastic resistive matrix disposed as a layer on said substrate and having a layer thickness, said carbon being a conductive current carrying phase of the matrix wherein a higher percentage of carbon relative to the percentage of plastic in the carbon and plastic resistive matrix produces a lower resistance and a lower percentage of carbon relative to the percentage of plastic in the carbon and plastic resistive matrix produces a higher resistance, particles of the conductive phases being embedded in a surface of said layer of resistive matrix and exposed and projecting therefrom in sliding contact with the wiper contact reducing variations in resistance between the wiper contact and the resistance element over the life of the device and being present in sufficient amount within a volume of said layer without excessively altering the resistive properties of said resistive matrix.

8. The resistance element of claim 7 wherein the conductive phases consist of silver.

9. The resistance element of claim 7 wherein the conductive phases consist of silver and palladium.

10. The resistance element of claim 7 wherein the conductive phases are selected from the group consisting of silver, palladium, gold, platinum, copper, highly conductive carbon, and combinations thereof.

11. The resistance element of claim 7 wherein the conductive phases are present in an amount equal to about 10 to 20 percent by weight of the resistive element.

12. The resistance element of claim 7 wherein the conductive phases are present in an amount equal to about 2 to 50 percent by weight of the resistive element.

13. A method of manufacturing a conductive resistance element of claim 1 in a potentiometric device having a wiper contact, comprising the steps of:

processing carbon powder, resin, solvent and conductive phases to form a paste, applying the paste to a substrate, and curing the paste in situ to drive off the solvent and form a film, with the conductive phases rising to the surface of the film and becoming embedded therein.

14. The method of claim 13 wherein the paste is cured at a temperature on the order of 200° C.

15. The method of claim 13 wherein the paste is screen printed onto the substrate.

16. The method of claim 13 wherein the carbon powder, resin, solvent and conductive phases are processed in a high shear mixer.

17. The method of claim 13 wherein:

the film is disposed as a layer on said substrate and has a layer thickness, said carbon being a current carrying phase of the film wherein a higher percentage of carbon relative to the percentage of plastic in the carbon and plastic resistive film produces a lower resistance and a lower percentage of carbon relative to the percentage of plastic in the carbon and plastic resistive film produces a higher resistance; and the particles of conductive material are embedded in the surface of said film and exposed and projecting, therefrom in sliding contact with the wiper contact, said particles of conductive material forming a conductive phase at the surface operative to reduce a contact resistance between said resistive element and said wiper contact and being present in sufficient amount within a volume of said layer without excessively altering the resistive properties of said conductive resistive element.

18. The method of claim 13, wherein the particles of conductive material are no larger than about 6 microns.

19. The method of claim 13, wherein the conductive material is deagglomerated smooth generally round metallic silver powder that promotes good electrical contact with said wiper and does not tend to join together and thereby does not excessively lower the resistance of the carbon-plastic resistive matrix.

20. The method of claim 13, wherein the conductive material is silver and palladium deagglomerated spherical metallic powder containing about 70 percent silver and 30 percent palladium that promotes good electrical contact with said wiper and does not tend to join together and thereby does not excessively lower the resistance of the carbon-plastic resistive matrix.

21. The method of claim 13, wherein the conductive phases consist of silver.

22. The method of claim 13, wherein the conductive phases consist of silver and palladium.

23. The method of claim 13, wherein the conductive phases are selected from the group consisting of silver, palladium, gold, platinum, copper, highly conductive carbon, and combinations thereof.

24. The method of claim 13, wherein the conductive phases are present in an amount equal to about 10 to 20 percent by weight of the resistive element.

25. The method of claim 13, wherein the conductive phases are present in an amount equal to about 2 to 50 percent by weight of the resistive element.

* * * * *